US005756925A

United States Patent [19]

Frank et al.

[11] Patent Number: 5,756,925

[45] Date of Patent: May 26, 1998

[54] PRECISION FLYER INITIATOR

[75] Inventors: Alan M. Frank; Ronald S. Lee, both of Livermore, Calif.

[73] Assignee: The United States of America as represented by the United States Department of Energy, Washington, D.C.

[21] Appl. No.: 652,086

[22] Filed: May 23, 1996

[51] Int. Cl.[6] ..... F42B 3/10; F42C 19/08

[52] U.S. Cl. ..... 102/202.7; 102/202.5; 102/202.14; 102/275.8; 102/275.11; 86/20.1

[58] Field of Search ..... 102/202.7, 202.5, 102/202.14, 201, 275.4, 275.5, 275.8, 275.11, 306, 204; 86/20.1

[56] References Cited

U.S. PATENT DOCUMENTS

| | | | |
|---|---|---|---|
| 1,991,856 | 2/1935 | La Motte et al. | 102/275.11 |
| 2,986,089 | 5/1961 | Meddick . | |
| 3,444,810 | 5/1969 | Hakala . | |
| 3,517,615 | 6/1970 | Jacobs . | |
| 3,611,932 | 10/1971 | Clator . | |
| 3,736,875 | 6/1973 | Bucklishch . | |
| 4,594,947 | 6/1986 | Aubry et al. . | |
| 4,602,565 | 7/1986 | MacDonald et al. | 102/202.7 |
| 4,635,145 | 1/1987 | Johnson et al. | 102/202.5 |
| 4,764,316 | 8/1988 | Brown et al. | 264/3.1 |
| 4,788,913 | 12/1988 | Stroud et al. . | |
| 4,829,901 | 5/1989 | Yates, Jr. . | |
| 4,852,493 | 8/1989 | Boberg et al. . | |
| 4,852,495 | 8/1989 | Hancock et al. . | |
| 4,862,803 | 9/1989 | Nerheim et al. . | |
| 4,885,993 | 12/1989 | Hancock et al. . | |
| 4,989,515 | 2/1991 | Kelly et al. | 102/202.9 |
| 5,031,538 | 7/1991 | Dufrane et al. . | |
| 5,094,166 | 3/1992 | Hendley, Jr. | 102/202.7 |
| 5,133,257 | 7/1992 | Jonsson | 102/210 |
| 5,370,053 | 12/1994 | Williams et al. . | |
| 5,409,259 | 4/1995 | Cunningham et al. | 280/741 |
| 5,505,134 | 4/1996 | Brooks et al. | 102/202.7 |

*Primary Examiner*—Michael J. Carone
*Assistant Examiner*—Christopher K. Montgomery
*Attorney, Agent, or Firm*—Gary R. Drew; William C. Daubenspeck; William R. Moser

[57] ABSTRACT

A precision flyer initiator forms a substantially spherical detonation wave in a high explosive (HE) pellet. An explosive driver, such as a detonating cord, a wire bridge circuit or a small explosive, is detonated. A flyer material is sandwiched between the explosive driver and an end of a barrel that contains an inner channel. A projectile or "flyer" is sheared from the flyer material by the force of the explosive driver and projected through the inner channel. The flyer than strikes the HE pellet, which is supported above a second end of the barrel by a spacer ring. A gap or shock decoupling material delays the shock wave in the barrel from predetonating the HE pellet before the flyer. A spherical detonation wave is formed in the HE pellet. Thus, a shock wave traveling through the barrel fails to reach the HE pellet before the flyer strikes the HE pellet. The precision flyer initiator can be used in mining devices, well-drilling devices and anti-tank devices.

23 Claims, 4 Drawing Sheets

PRECISION FLYER INITIATOR

STATEMENT AS TO RIGHT OF INVENTION

The United States Government has rights in this invention pursuant to Contract No. W-7405-ENG-48 between the United States Department of Energy and the University of California for the operation of the Lawrence Livermore National Laboratory.

BACKGROUND OF THE INVENTION

1. Field of the Invention

This invention relates to improvements in the controlled detonation of explosive shaped charges. More particularly, this invention relates to detonating an explosive charge such that a spherical detonation wave emanates from a single, precisely centered, point of origin.

2. Description of the Related Art

Shaped charges are used in the military, for example, in mine clearing, anti-tank and anti-submarine devices. The explosive shaped charge devices are also used in the oil and mining industries for deep fracturing of wells. Thus, a controlled detonation of a shaped charge is highly desirable. The performance of shaped charges depends on a spherical initiation wave that is precisely centered in the charge.

A device previously used for shaped charge initiation is called the Precision Initiation Component (PIC). Referring to FIG. 1, a PIC 10 contains a cylinder 12 and a driver 18. The interior shape of the cylinder 12 is more clearly shown in the cross-sectional view of FIG. 2. The hourglass or biconical shape of the interior of the cylinder 12 is packed with a high explosive (HE) material 14. The bottom portion of the cylinder 12 is attached to the driver 18, which initiates a detonation wave in the HE 14. The neck 20 of the cylinder 12 reduces the detonation wave to a small region such that the detonation wave at the output plane 16 appears to be spherically emanating from a source at the neck 20.

The PIC 10 is not an ideal detonation device because it fails to form a perfectly spherical wave emanating from a precise point of origin. The smaller the neck 20, the more perfectly spherical the output wave. However, the minimum diameter of the neck 20 is limited by the critical diameter for maintaining a detonation wave in the HE 14. Attempts to make a PIC 10 more accurate by reducing the diameter of the neck 20 fail at the critical diameter because the detonation wave fails to propagate beyond the neck 20.

Furthermore, the PIC 10 has an hourglass or biconical shape, which makes it difficult to fill with HE 14 without creating density variations or gradients. Density gradients in the HE 14, especially between the neck 20 and the output plane 16, cause detonation velocity variations and thus degrade the spherical shape of the output wave. Also, the shape of the PIC 10, especially in the neck area, is difficult and expensive to uniformly press. The pressing nonuniformities result in detonation velocity variations, which can dramatically degrade the shape of the output wave. For small devices, the finite diameter of the neck both degrades the sphericity of the wave and can transmit distortions from the initiating wave front. Because shaped charges are becoming smaller and their shapes more complex, PICs can not meet the more stringent initiation requirements necessary for these smaller and more complex shaped charges.

FIG. 3 represents a cross-sectional view of a type of detonation device called a slapper detonator 30, which is commonly used in precision HE initiation. A slapper detonator 30 consists of an exploding bridge circuit 34 formed on a laminated printed circuit board 32. A thin foil 36 is sandwiched between the exploding bridge circuit 34 and a barrel 38. The barrel 38 has a hollow cylindrical center 40 that forms a passage between the thin foil 36 and the HE 42. The HE 42 may either be an initiating pellet or the main charge.

The exploding bridge circuit 34 on the circuit board 32 has two metal leads which are connected by a thin "bridge" section. When a large current is passed through the bridge, it explodes and vaporizes. A section of the thin foil 36 is cut and forced through the hollow cylindrical center 40 of the barrel 38. The foil is propelled at high velocity and "slaps" against the HE 42 such that a shock wave is formed that detonates the HE 42.

The advantages of this barrel design is that the hollow cylindrical center 40 of the barrel 38 can be narrower and easier to manufacture than the neck of the barrel in the PIC and that no additional initiator is required. If the HE 42 is a precision pressed pellet with a sufficiently small failure diameter, which is the minimum diameter to propogate the detonation wave, then a considerably smaller initiation point and closer to spherical output can be achieved as compared to a PIC. However, the shortcoming of the slapper detonator is that it requires a complex and expensive high powered electrical current source to explode the bridge.

Neither the PIC nor the exploding bridge circuit provides a simple manufacturable device that forms a spherical initiation wave located at a precise point.

SUMMARY OF THE INVENTION

An object of the present invention is to detonate an explosive charge with any initiation source to form a spherical detonation wave emanating from a precisely located single point.

The precision flyer initiator is a device for precise initiation of an explosive device such as a shaped charge by forming a spherical wave emanating from a precise point of origin. The precision flyer initiator has an explosive driver, such as a small explosive, a detonating cord or an electrically exploded bridge circuit. A flyer material is sandwiched between the explosive driver and an end of a barrel that contains an inner channel. When the explosive driver is detonated, a projectile or "flyer" is sheared from the flyer material and projected through the inner channel. The flyer then strikes a precision HE pellet, which is supported above a second end of the inner channel by a spacer. The spacer isolates the HE pellet from the shock wave in the barrel ensuring that only the impact of the flyer initiates the HE pellet. The precision pellet, which has an uniform density, is required for spherical propagation of the detonation wave initiated by the flyer.

The precision flyer initiator is an easily manufacturable device that provides better centering and a more spherical initiation than other devices. The precision flyer initiator also can provide precision initiation from asymmetric sources such as detonator cord.

BRIEF DESCRIPTION OF THE DRAWINGS

For a better understanding of the invention and further features thereof, reference is made to the following detailed description of the invention to be read in connection with the accompanying drawings, wherein.

DETAILED DESCRIPTION OF THE PREFERRED EMBODIMENTS

While this invention is described in some detail herein, with specific reference to illustrated embodiments, it is to be understood that there is no intent to be limited to these embodiments. On the contrary, the aim is to cover all modifications, alternatives and equivalents falling within the spirit and scope of the invention as defined by the claims. Specifically, the invention is applicable to any situation where a flyer is accelerated through a barrel, across a decoupling space, to precision initiate an HE device. Further, the precision flyer initiator can be used in a variety of devices depending on the object of the explosion.

Figure 1:
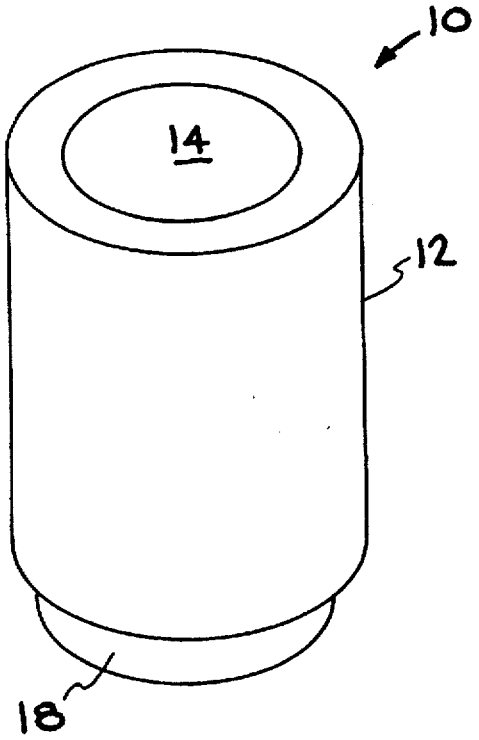
FIG. 1 (PRIOR ART)
FIG. 1 is a three dimensional drawing of a precision initiator component of the prior art.
Figure 2:
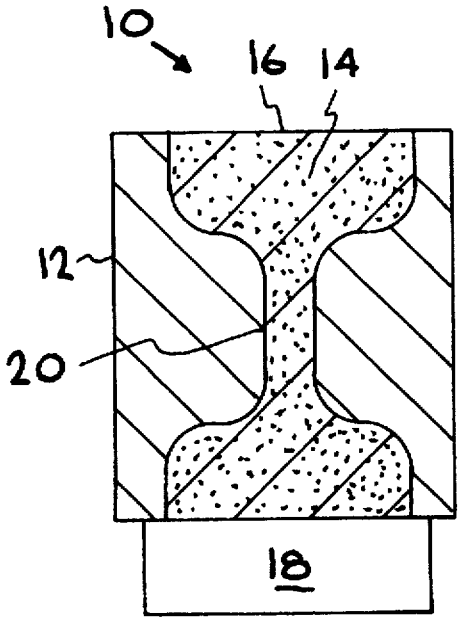
FIG. 2 (PRIOR ART)
FIG. 2 is a cross-sectional view of the precision initiator component shown in FIG. 1.
Figure 3:
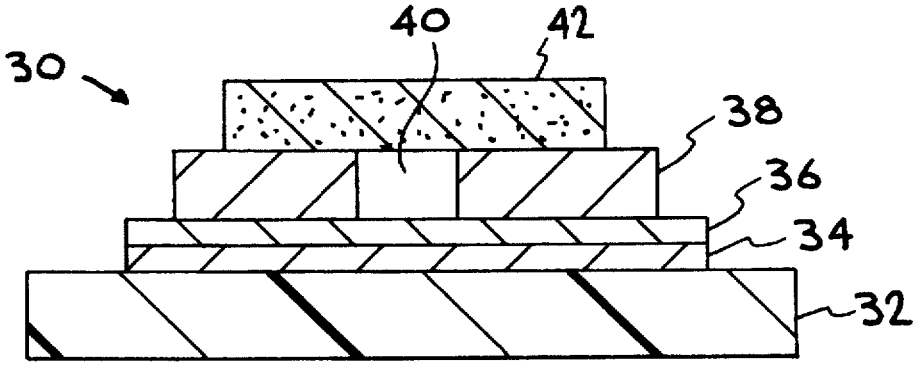
FIG. 3 (PRIOR ART)
FIG. 3 is a slapper detonator of the prior art.
Figure 4:
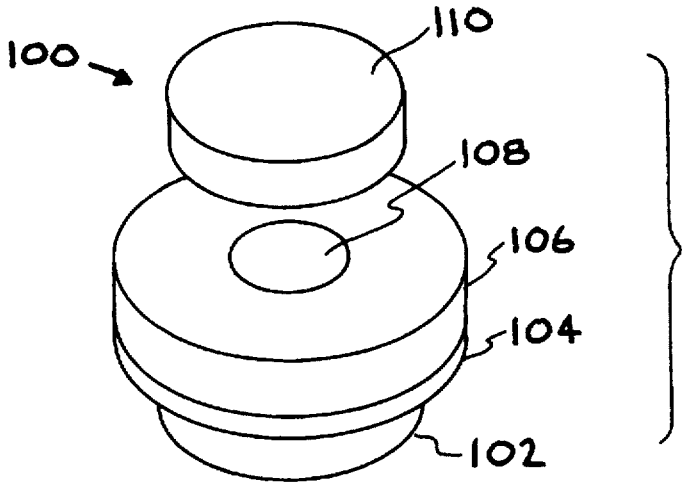
FIG. 4 is three dimensional representation of a first preferred embodiment of the precision flyer initiator of the present invention.

The object of an ideal detonation device for an explosive device, such as a shaped charge, is to form a perfectly spherical wave emanating from a precise point of origin. A first preferred embodiment of a precision flyer initiator of the present invention will be described with reference to FIG. 4 and FIG. 5. The precision flyer initiator 100 has an explosive driver 102, which can be an explosive or a detonating cord. In the alternative, an electrically exploding bridge as described in the prior art could be used as the driver 102. A flyer material 104, which is a piece of flat material, is sandwiched between the explosive driver 102 and a barrel 106 having a cylindrical channel 108. The flyer material 104 can be metal, plastic, or other suitable flyer material known in the art. The flyer material 104 must be large enough to completely cover the diameter of the cylindrical channel 108 and at least extend over the planar surface 120 of the barrel 106 closest to the edge of the cylindrical channel. The diameter of the cylindrical channel 108, for example, can be approximately 0.5 mm, which is substantially smaller than the diameter of the neck in a typical PIC. The barrel 106 can be formed from a sheet of dense, strong material such as steel or tantalum. However, the barrel material must be denser than the flyer material so that a flyer 114 can be sheared from the flyer material 104 and propelled through the cylindrical channel 108.

Figure 5:
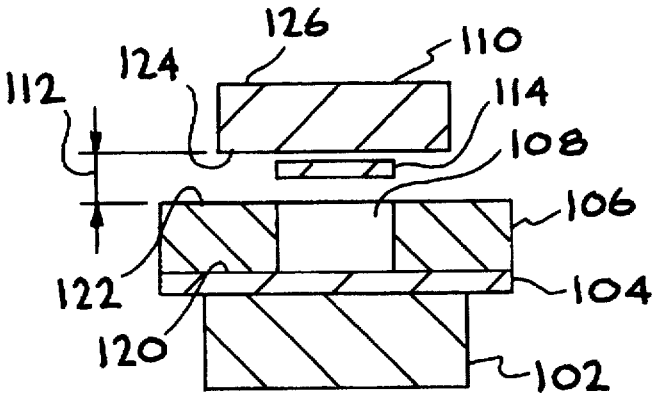
FIG. 5 is a cross-sectional view of the first preferred embodiment taken through the center of the precision flyer initiator.

A precision high explosive pellet (HE pellet) 110 is located at the other planar surface 122 of the barrel 106. However, there is a gap 112 between the planar surface 122 and the surface 124 of the HE pellet 110 as shown in FIG. 5. This gap 112 prevents a shock wave traveling through the barrel 106 from reaching the HE pellet 110 before the flyer 114 strikes or "slaps" the HE pellet.

When the flyer 114 impacts the surface 124 of the HE pellet 110, a shock wave is formed in the HE pellet that is quickly transformed into a detonation wave. The distance between flyer impact and the formation of the detonation wave is a called the run-to-detonation distance. However, the shock wave decays as it travels through the HE pellet 110. Thus, the flyer must be large enough to form a shock wave that will be transformed into a detonation wave. Another consideration is that density gradients within the HE pellet 110 can cause detonation velocity variations that will distort a detonation wave such that it is not spherical. To form an HE pellet 110 that will generate a nearly perfect spherical wave, the HE pellet 110 must be manufactured to minimize these density gradients. This material can be any appropriate HE, such that its run-to-detonation distance is small with respect to the diameter of the flyer. The formulations LX-16 (PETN, pentacrythritol-tetranitrate) and LX-14 (HMX, cyclotetramethylenetetranitramine, homocyclonite) were both used in the initial realizations of the precision flyer initiator. However, other suitable explosive material and binders can be used such as cyclonite (RDX), hexanonytrostilbene (HNS) and triaminotrinitrobenzene (TATB).

The key steps in manufacturing a gradient-free pellet are leveling the powder in the die, heating and evacuating the air from the die before pressing. Powder poured into a die normally forms a mound in the center, which upon pressing forms a radial density gradient. By leveling the powder before pressing, this radial gradient is eliminated. Heating the die adds some fluidity to the material; this reduces or eliminates the axial gradient, which is the result of the action of the ram pressing into the die cavity. Evacuating the die eliminates voids and low density regions due to trapped air.

To initiate a spherical wave at a precise point, the explosive driver 102 is detonated. The projectile or "flyer" 114 is sheared from the flyer material 104 by the force of the explosive driver 102, which is acting against the denser barrel 106, and is projected through the cylindrical channel 108. The flyer 114 traverses the gap 112 and strikes the HE pellet 110 to initiate the spherical wave detonation. A shock wave is also produced in the barrel 106 by the explosive driver 102. The shock wave traveling through the barrel material travels faster than the flyer 114. Thus, the shock wave would prematurely initiate the HE pellet 110 over a large imprecise region before the arrival of the flyer 114. To prevent this premature initiation of the HE pellet 110, a gap 112 is provided between the barrel and the HE pellet. The gap 112 decouples the shock wave from the barrel 106 so that it fails to reach the HE pellet 110 before the flyer 114.

Figure 6:
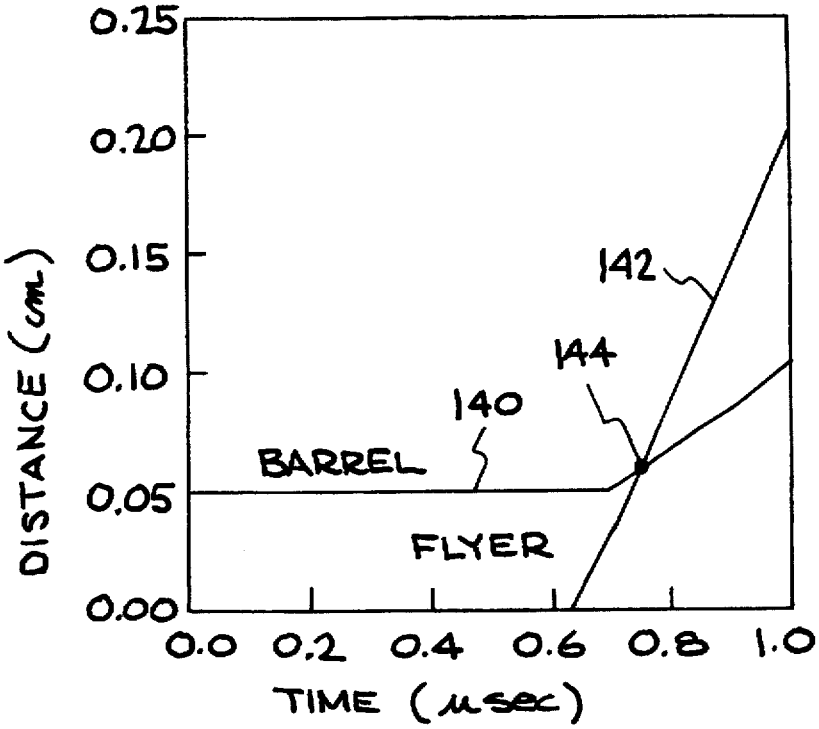
FIG. 6 is a graph showing the movement of the surface of the barrel due to the compression wave of the shock wave relative to the movement of the flyer.

Referring to FIG. 6, the graph shows the relationship between the movement of the planar surface 122 of the barrel 106 relative to the movement of the flyer 114 in the cylindrical channel 108. For this example, the depth of the barrel 106, which is also the length of the cylindrical channel 108, is 0.05 cm. The barrel 106 was made of stainless steel and the flyer 114 was made of aluminum. Referring to the graph, line 140 illustrates movement of the planar surface 122 of the barrel 106 due to the compression wave of the shock wave traveling through the barrel as a function of time. Line 142 illustrates the movement of the flyer 114 as a function of time.

The flyer 114 begins to move through the cylindrical channel 108 around 0.6 μsec (micro-seconds) after detonation of the explosive driver 102. The shock wave in the barrel 106 reaches the planar surface 122 of the barrel 106 and the compression wave of the shock wave begins to move the planar surface. Eventually, the shock wave is transferred to the next medium, for example, air or the HE pellet 110. Thus, the planar surface 122 begins to move through the gap 112 at approximately 0.7 μsec after detonation of the explosive driver 102. At this time, the flyer 114 has traveled only 0.04 cm. Therefore, the compression wave at the surface 122 of the barrel 106 would initiate a detonation wave in the HE pellet 110 if the barrel was in direct contact with the HE pellet. An essential feature of the first preferred embodiment is the gap 112 between the surface 122 of the barrel 106 and the HE pellet 110. The purpose of the gap 112 is to decouple the HE pellet 110 from the shock wave in the barrel 106 in order to prevent initiation of the HE pellet until the arrival of the flyer 114.

Referring to FIG. 6, point 144 illustrates when the flyer 114 and the shock wave from the barrel 106 reach the HE pellet 110 at the same time. This distance is computed to be 0.06 cm from the base of the barrel 106 or 0.01 cm beyond the surface 122 of the barrel. The barrel shock wave is now traveling through the air, which is slower than when it was traveling through the barrel 106. However, the velocity of the flyer 114 is unchanged, thus the flyer passes the shock wave. In order to account for variances between theoretical and actual performance and variations in manufacturing, the gap 112 in the first preferred embodiment is designed to be approximately 0.05 cm. As an alternative, the gap 112 could be filled with a low density shock decoupling material (not shown) such as a foam or low density plastic. In this case, the cylindrical channel 108 would extend through both the barrel 106 and the low density shock decoupling material.

Another advantage of the present invention is that the explosive driver 102 does not have to be a precision element. The precision derives from the small size of the projectile 114 and the alignment of the barrel 106 to the HE pellet 110. No matter what the type or orientation of the driver, the largest error in the initiation position will be the radius of the flyer 114.

Figure 7:
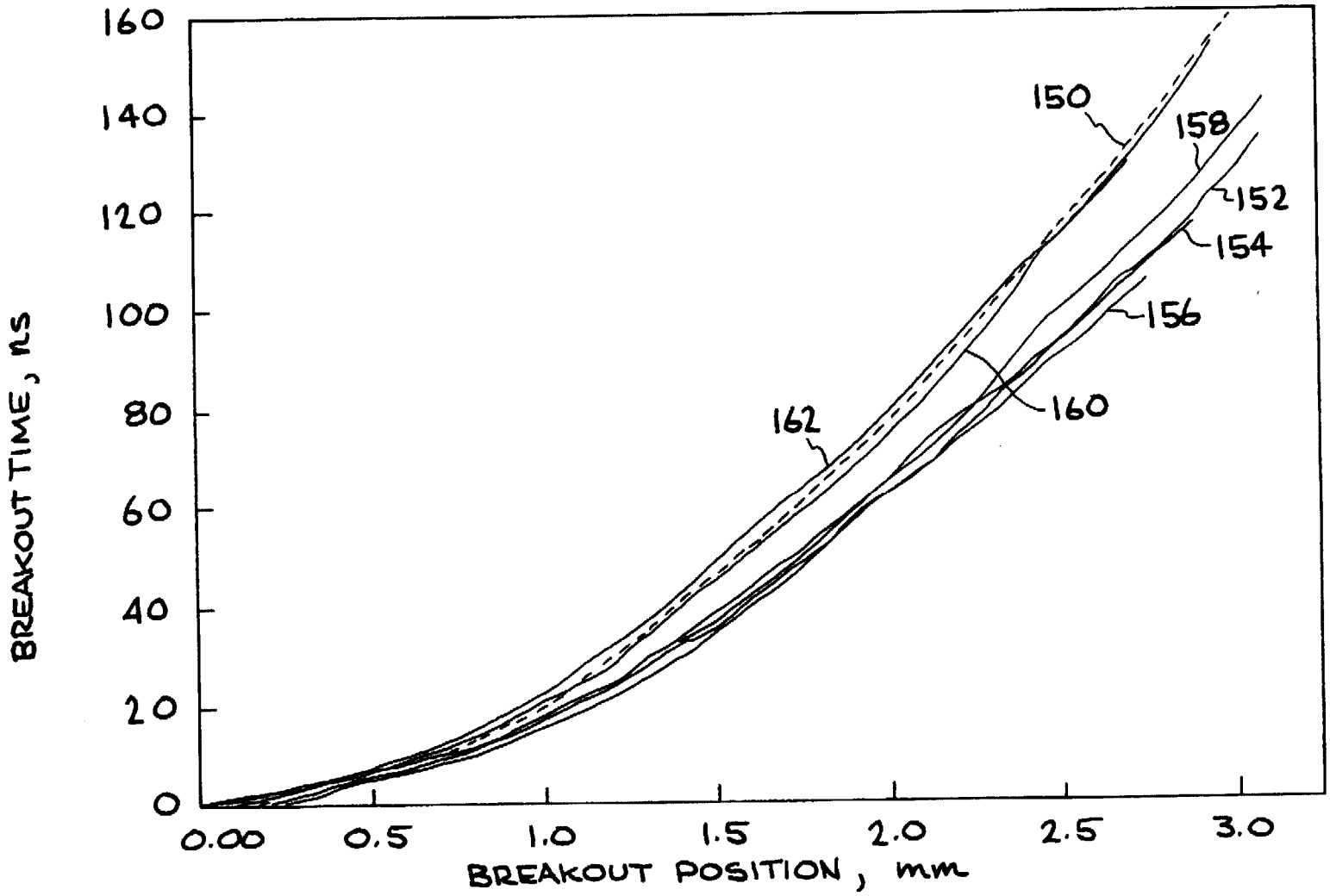
FIG. 7 is a graph illustrating experimental and theoretical plots of the timing of detonation waves breaking through the surface of the HE pellet.

FIG. 7, shows a series of experimental and theoretical plots of the timing of detonation waves breaking through the planar output surface 126 of the HE pellet 110. The plots are normalized to the initial breakout at the center of the HE pellet 110, then the delay of the breakout is recorded as a function of the radius from the center. The dotted line 150 represents the computed ideal breakout for a perfect point initiation and spherical detonation wave passing through the planar surface of the HE pellet 110. The other curves 152–162 are actual experimentally measured breakouts for several HE pellets 110. Curves 152–158 are the measured breakouts for a precision flyer initiator where the diameter of the cylindrical channel 108 of the barrel 106 was 0.1 cm. Note that these curves 152–158 deviate substantially from the ideal curve 150. For curves 160–162, the cylindrical channel 108 diameter was reduced to 0.05 cm. To within the accuracy of the measurement, the curves 160–162 precisely overlay the ideal 150, thus demonstrating a truly spherical detonation wave.

Figure 8:
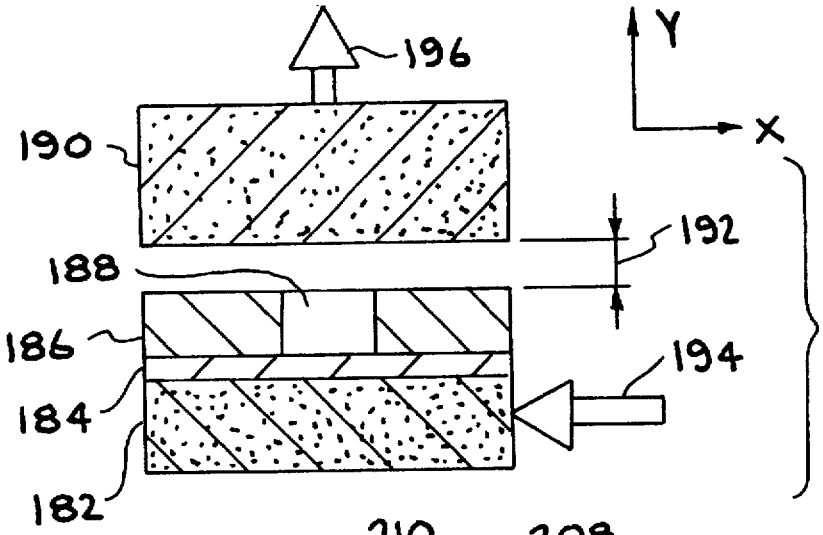
FIG. 8 is a cross sectional view of a second preferred embodiment of a precision flyer initiator.

A second preferred embodiment takes advantage of the fact that the initial driving charge need not be a precision element. In the second embodiment, the initiation wave is traveling perpendicular to the direction of the output detonation or any angle in between. Referring to FIG. 8, the device is similar to the device shown in FIG. 4, except that the input axis X of propagation of the detonation wave 194 in the driver 182 is perpendicular to the output axis Y of the initiation wave 196 in precision pellet 190. For example, the driver 182 could be an explosive detonation cord, which would form an initiation wave in the direction of the propagation wave 194. The orthogonal propagation of the initiation wave will cause a tilt in the flyer formed from the flyer material 184, which in turn will cause an offset from center of the initiation point in the precision pellet 190. The action of the barrel 186 will limit and regulate the amount of the offset. Additionally, the thickness of the gap 192 must be larger than in the first embodiment in order to accommodate the earlier motion of the barrel 186, which begins to move as the initiation wave passes the edge of the barrel. For a given configuration, the offset can be measured and the position of the barrel 186 can be adjusted to compensate for this early movement of the barrel thus yielding a centered spherical initiation of the output pellet 190.

Figure 9:
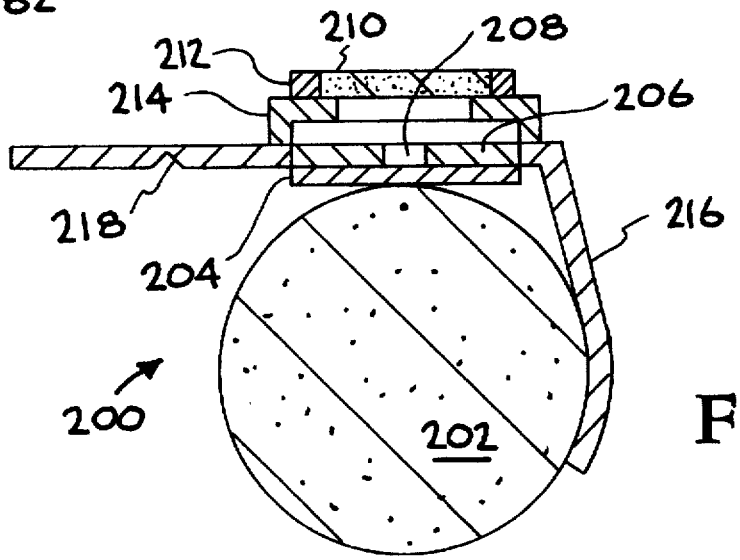
FIG. 9 is a cross-sectional view of a third preferred embodiment of a precision flyer initiator using a detonation cord.

A third preferred embodiment is a specific application of the first and second embodiments. Referring to FIG. 9, a cross-sectional view of a precision flyer initiator of the third preferred embodiment 200 is shown. In this embodiment, the explosive initiation charge 182 of the second preferred embodiment is replaced by an explosive detonation cord 202. Some situations require many shaped charges to be detonated such that each shaped charge forms a spherical detonation wave from a point source at a precise location. It is highly desirable to initiate strings of shaped charges with detonation cords 202. However, the detonation wave running along a detonation cord 202 provides neither a precise location nor a point source. Therefore, the third preferred embodiment uses the detonation cord 202 to provide the energy needed to launch a flyer to detonate a precision HE pellet 210. The accuracy of the detonation is based on the alignment of the barrel's cylindrical channel 208 with the HE pellet 210, the size of the cylindrical channel, and the manufacturing precision of the HE pellet.

The precision flyer initiator 200 has a detonation cord 202 positioned in a direction that is perpendicular to the plane of the FIG. 9. As the detonation wave of the ignited detonation cord 202 passes by the flyer material 204, the flyer (not shown) is sheared from the flyer material by the pressure force of the ignited detonation cord. The flyer is projected through the cylindrical channel 208 of the barrel 206 as in the previous embodiments. The barrel 206 is made of a material denser than the flyer.

The flyer then strikes the precision HE pellet 210, which is formed by the method described in the first preferred embodiment, at a high velocity to generate the spherical detonation wave in the HE pellet. The HE pellet 210 must be manufactured to minimize density gradients which would distort the spherical detonation wave. The HE pellet 210 is positioned over the end of the barrel 206 by using a mating ring 212 and a spacer ring 214. These rings can be made of metal or durable plastic. The spacer ring 214 maintains the necessary gap so that the flyer will detonate the HE pellet before the barrel shock wave. The mating ring 212, which is coupled to the spacer ring 214, supports and holds the HE pellet 210 in place.

An optional crimped retaining band 216 holds the barrel 206, the spacer ring 214 and the detonation cord 202 in place. The retaining band 216 must be constructed to prevent the shock wave produced by the detonation cord 202 and traveling in the retaining band from arriving at the barrel 206 before the flyer has passed through. Thus, the retaining band 216 is designed such that cuts or detents 218 are formed in the material of the retaining band before crimping the retaining band around the detonation cord 202. Therefore, a sufficient portion of the retaining band 216 is isolated from the detonation cord 202. The shock wave velocity in the retaining band 216 may be higher than the velocity of the flyer. Therefore, the structural shape of the retaining band 216 must be calculated to provide shock wave transit times longer than flyer transit time in order to prevent a detonation of the HE pellet 210 by the shock wave traveling through the retaining band 216.

Figure 10:
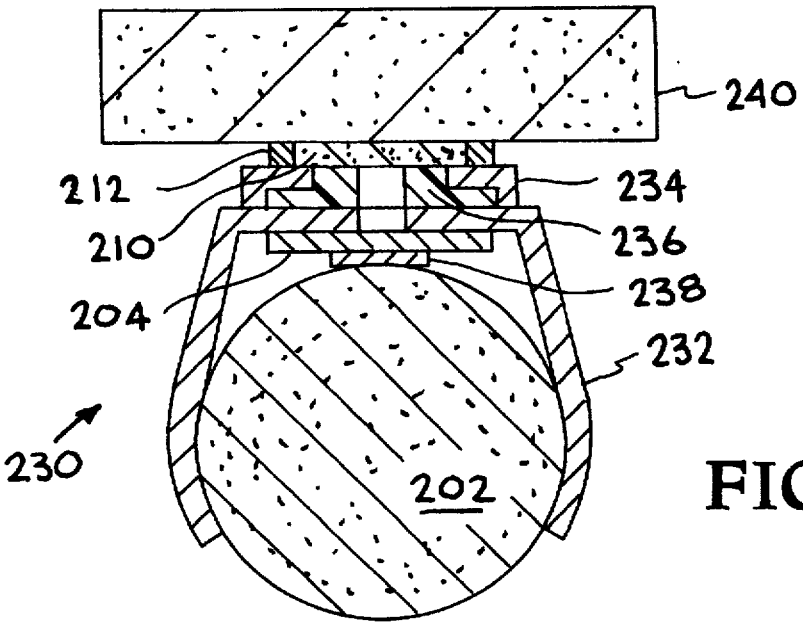
FIG. 10 is a cross-sectional view of a fourth preferred embodiment of a precision flyer initiator.

A fourth preferred embodiment is shown in FIG. 10. Similar structures shown in the third preferred embodiment are identically numbered in this embodiment. Referring to FIG. 10, the retaining band 216 and the barrel 206 are replaced by a single retaining band 232. A spacer ring 234 is used to maintain the gap between the barrel portion of the retaining band 232 the HE pellet 210. In the alternative, this spacer ring 234 could be incorporated into the retaining band 232. Also, the gap between the HE pellet 210 and the barrel portion of the retaining band 232 is filled with a low density shock decoupling material 236 such as foam or low density plastic. The cylindrical channel, which the flyer passes, extends through the barrel portion of the retaining band 232 and the filler material 236.

To reduce the amount of high explosive material in the detonation cord 202, an additional booster HE pellet 238 may be placed between the detonation cord 202 and the flyer material 204. Thus, the detonation cord 202 would ignite the booster HE pellet 238, which would provide the shearing force to form the flyer.

FIG. 10 shows one of many uses for the precision initiator flyer. A shaped charge 240, which is known in the prior art, may be placed above the HE pellet 210. After the flyer strikes the HE pellet 210, the spherical wave formed and propagated through the HE pellet would detonate the shaped charge 240. The spherical wave formed in the present invention could also be used to detonate a mine clearing device, an anti-tank device, an anti-submarine device or a well-perforating device for deep fracturing of wells.

Although the invention has been described and illustrated with particularity, it is intended to be illustrative of preferred embodiments. It is understood that the disclosure has been made by way of example only. Numerous changes in the combination and arrangements of the parts, steps and features can be made by those skilled in the art without departing from the spirit and scope of the invention, as hereinafter claimed.

What is claimed is:

1. A precision flyer initiator used to form a substantially spherical detonation wave comprising:

a driver generating a force;

a barrel having an inner channel;

a flyer material sandwiched between said driver and a first end of said barrel, said flyer material forming a flyer driven through said inner channel by said force;

a precision high explosive pellet; and support means for separating said high explosive pellet from a second end of said barrel by a gap, said support means having an inner diameter substantially greater than a diameter of said inner channel such that said flyer detonates said precision high explosive pellet before a shock wave generated by said driver traverses said barrel and said gap.

2. The precision flyer initiator of claim 1, wherein the gap between said barrel and the high explosive pellet is filled with a low density shock decoupling medium that has an inner channel continuous with the inner channel of said barrel.

3. The precision flyer initiator of claim 2, wherein said low density shock decoupling medium is one of a foam and a low density plastic.

4. The precision flyer initiator of claim 1, wherein said support means comprises a spacer ring coupled to a surface of said second end of said barrel end and the surface of said pellet.

5. The precision flyer initiator of claim 4, wherein said support means comprises a mating ring coupled to said spacer ring, said mating ring surrounding a circumferential edge of said high explosive pellet.

6. The precision flyer initiator of claim 1, wherein said flyer material is one of a metal and a plastic.

7. The precision flyer initiator of claim 1, wherein said barrel is formed from a material having a greater density than said flyer material.

8. The precision flyer initiator of claim 7, wherein said barrel is formed from a sheet of material composed of one of steel and tantalum.

9. The precision flyer initiator of claim 1, wherein said driver is one of an exploding bridge circuit, a detonating cord, and an explosive material.

10. The precision flyer initiator of claim 1, wherein said high explosive pellet has a substantially uniform density.

11. The precision flyer initiator of claims 10, wherein said high explosive pellet is formed from a high explosive material composed of one of pentacrythritoltetranitrate (PETN), cyclotetramethylenetetranitramine (homocyclonite) (HMX), cyclonite (RDX), hexanonytrostilbene (HNS) and triaminotrinitrobenzene (TATB).

12. The precision flyer initiator of claim 11, wherein said high explosive material is combined with a binder material.

13. The precision flyer initiator of claim 1, wherein manufacturing the high explosive pellet comprises the steps of:

leveling a combination of an explosive material and a binder in a die;

heating the combination in an evacuated chamber; and pressing the combination to a substantially uniform density that is slightly less than a maximum uniform density of the combination.

14. The precision flyer initiator of claim 1, wherein the gap is between 0.1 mm and 10 mm.

15. The precision flyer initiator of claim 1, wherein the inner channel has a diameter between 0.1 mm to 10 mm.

16. The precision flyer initiator of claim 1, wherein said barrel and said support means are fabricated from a single material.

17. The precision flyer initiator of claim 1, wherein a direction of a detonation wave propagated through said driver is different than a direction of a output detonation wave propagated in the high explosive pellet.

18. The precision flyer initiator of claim 1, wherein the substantially spherical detonation wave is used to detonate one of a shaped charge, a mine clearing device, an anti-tank device, an anti-submarine device and a well-perforating device for deep fracturing of wells.

19. A well-perforating device contained within a housing for deep fracturing of a well comprising:

at least one shaped charge;

a driver generating a force;

at least one precision flyer initiator coupled to said at least one shaped charge, each precision flyer initiator having a barrel with an inner channel, a flyer material sandwiched between said driver and a first end of said barrel for forming a flyer driven through said inner channel by said force, a separation means having an inner diameter substantially greater than a diameter of said inner channel, and a precision high explosive pellet being supported by said separation means such that a gap separates a second end of the barrel and a surface of said precision high explosive pellet, wherein said flyer detonates said precision high explosive pellet before a shock wave generated by said driver traverses said barrel and said gap.

20. The well-perforating device of claim 19, wherein said separation means comprises a spacer ring coupled to a surface of said second end of said barrel and the surface of said precision high explosive pellet.

21. The well-perforating device of claim 19, wherein said driver is a detonation cord that is coupled to each of said precision flyer initiators.

22. The well-perforating device of claim 21, wherein said barrel and said separation means are coupled to a retaining clamp for coupling the precision flyer initiator to the detonation cord.

23. The well-perforating device of claim 21, wherein a booster high explosive pellet is sandwiched between said detonation cord and said flyer material.

* * * * *